US005619834A

United States Patent [19]

Chen

[11] Patent Number: 5,619,834

[45] Date of Patent: Apr. 15, 1997

[54] SLATE POSITIONING DEVICE

[76] Inventor: Laurance Chen, No. 80, Sec. 1, Lin An Road., Tainan, Taiwan

[21] Appl. No.: 567,514

[22] Filed: Dec. 5, 1995

[51] Int. Cl.[6] ..... E04B 1/38

[52] U.S. Cl. ..... 52/509; 52/235; 52/698; 52/713; 52/126.1

[58] Field of Search ..... 52/713, 698, 508, 52/509, 511, 513, 126.1, 126.5, 235; 248/229.1, 298.1, 287.1, 279.1

[56] References Cited

U.S. PATENT DOCUMENTS

| | | | |
|---|---|---|---|
| 3,350,830 | 11/1967 | Smith, Jr. et al. | 52/509 |
| 4,523,413 | 6/1985 | Koppenberg | 52/509 X |
| 5,239,798 | 8/1993 | Saito | 52/511 X |
| 5,265,396 | 11/1993 | Amimoto | 52/511 X |
| 5,280,690 | 1/1994 | Hu | 52/508 X |

FOREIGN PATENT DOCUMENTS

| | | | |
|---|---|---|---|
| 2532350 | 3/1984 | France | 52/126.1 |
| 4001806 | 7/1991 | Germany | 52/126.1 |
| 4272366 | 9/1992 | Japan | 52/126.1 |
| 0518098 | 1/1993 | Japan | 52/126.1 |
| 2164073 | 3/1986 | United Kingdom | 52/126.1 |

*Primary Examiner*—Carl D. Friedman
*Assistant Examiner*—Winnie Yip
*Attorney, Agent, or Firm*—Pro-Techtor International

[57] ABSTRACT

A slate positioning device comprises a positioning plate. The positioning plate has a horizontal plate and the first and the second longitudinal plates at two ends of the horizontal plate. The first longitudinal plate has a hole. The second longitudinal plate has an upper convex edge and a lower convex edge. A pad plate has a slot and a concave surface to cover the first longitudinal plate. The upper convex edge and the lower convex edge are inserted in the corresponding grooves of the corresponding slates. A screw rod passes through the hole and the slot to fasten the first longitudinal plate and the pad plate.

2 Claims, 11 Drawing Sheets

SLATE POSITIONING DEVICE

BACKGROUND OF THE INVENTION

The invention relates to a slate positioning device. More particularly, the invention relates to a positioning device for fast construction.

Referring to FIGS. 1 to 4, a conventional slate positioning device has a plate 2 overlapping an L-shaped plate 1. The L-shaped plate 1 has the first and second slots 11 and 12. The plate 2 has the third slot 22 and a hole 21. A screw rod 13 passes through the second slot 12 to fasten the L-shaped plate 1 on the wall A. The bolt 23, the washer 24 and the nut 25 fasten the plate 2 and the L-shaped plate 1 together. The pin 31 passes through the hole 21 of the plate 2 and the holes 31 of two slates 3. The user can apply silicone on the gap between two slates 3. However, the steel plate 2 with the thickness of about 4 mm cannot support the slates 3 individually. The pad C with the thickness of about 6 mm to 8 mm should infill the gap between two slates 3. The total weight is very heavy so that the whole construction is not safe. Further, it is difficult to apply silicone later. Since the wall may not be perfectly straight, a padding plate 10 is required to be placed between the screw rod 13 and the wall A. It is difficult to control the level of the L-shaped plate 1 precisely.

SUMMARY OF THE INVENTION

An object of the invention is to provide a slate positioning device for fast construction.

Another object of the invention is to provide a slate positioning device for precise construction.

According to an embodiment of the present invention, a slate positioning device has a positioning plate. The positioning plate has a horizontal plate and the first and the second longitudinal plates at two ends of the horizontal plate. The first longitudinal plate has a hole. The second longitudinal plate has an upper convex edge and a lower convex edge. A pad plate has a slot and a concave surface to cover the first longitudinal plate. The upper convex edge and the lower convex edge are inserted in the corresponding grooves of the corresponding slates. A screw rod passes through the hole and the slot to fasten the first longitudinal plate and the pad plate.

According to another embodiment of the present invention, a slate positioning device has an L-shaped plate, a horizontal positioning plate and a pad plate. The longitudinal plate which has a through hole, an upper convex edge and a lower convex edge is disposed at one end of the positioning plate. The L-shaped plate has a horizontal plate and a pendent plate. The horizontal plate has an orifice, and the pendent plate has an opening. The pad plate has a slot and a concave surface to cover the pendent plate. The positioning plate is disposed on the horizontal plate. A screw rod passes through the opening and the slot to fasten the pendent plate and the pad plate. A bolt passes through the through hole, the orifice, the washer and the nut to fasten the positioning plate and the horizontal plate together.

DETAILED DESCRIPTION OF THE INVENTION

Figure 1:
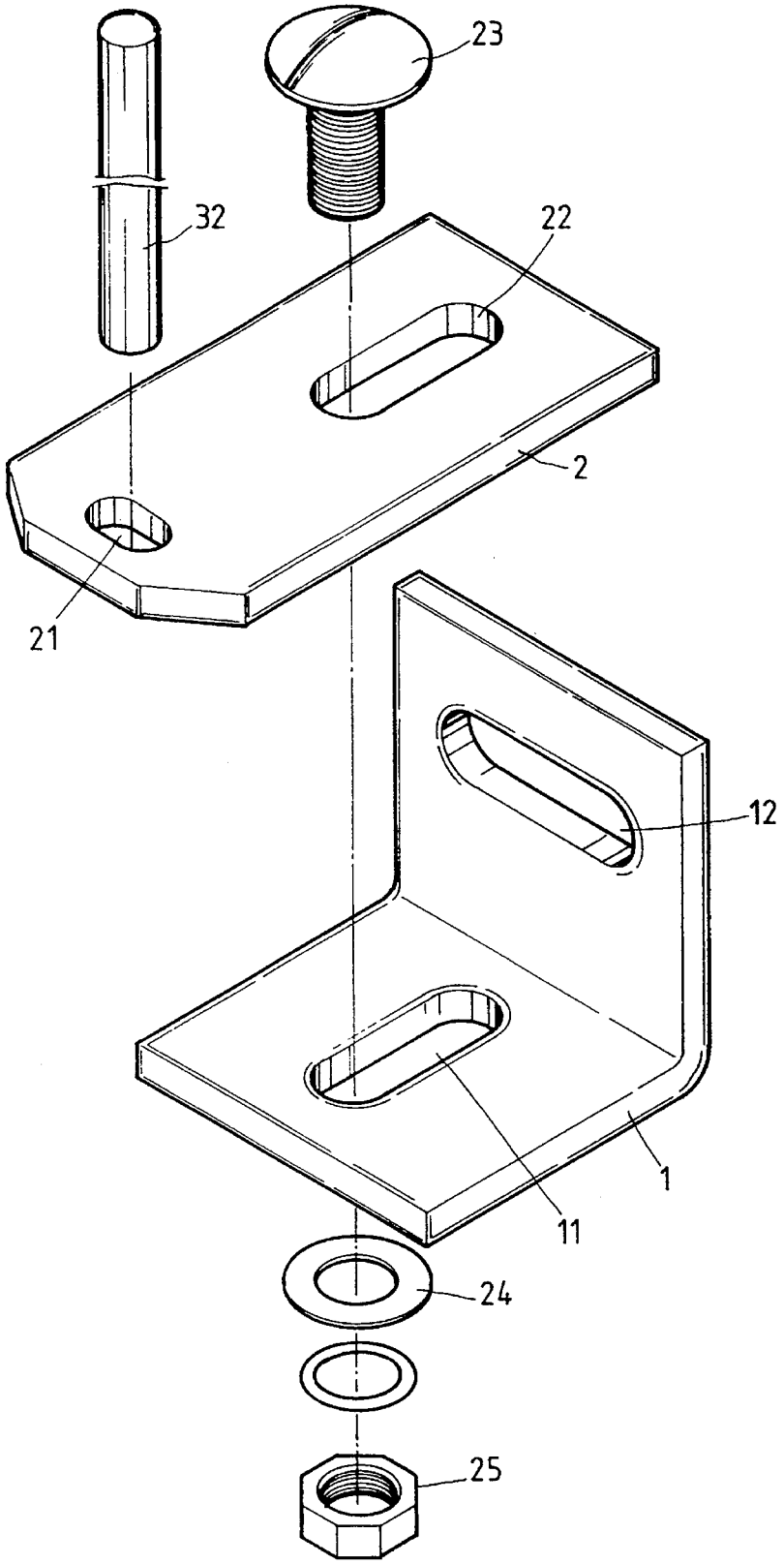
FIG.1 PRIOR ART
FIG. 1 is a perspective exploded view of a slate positioning device of the prior art.
Figure 2:
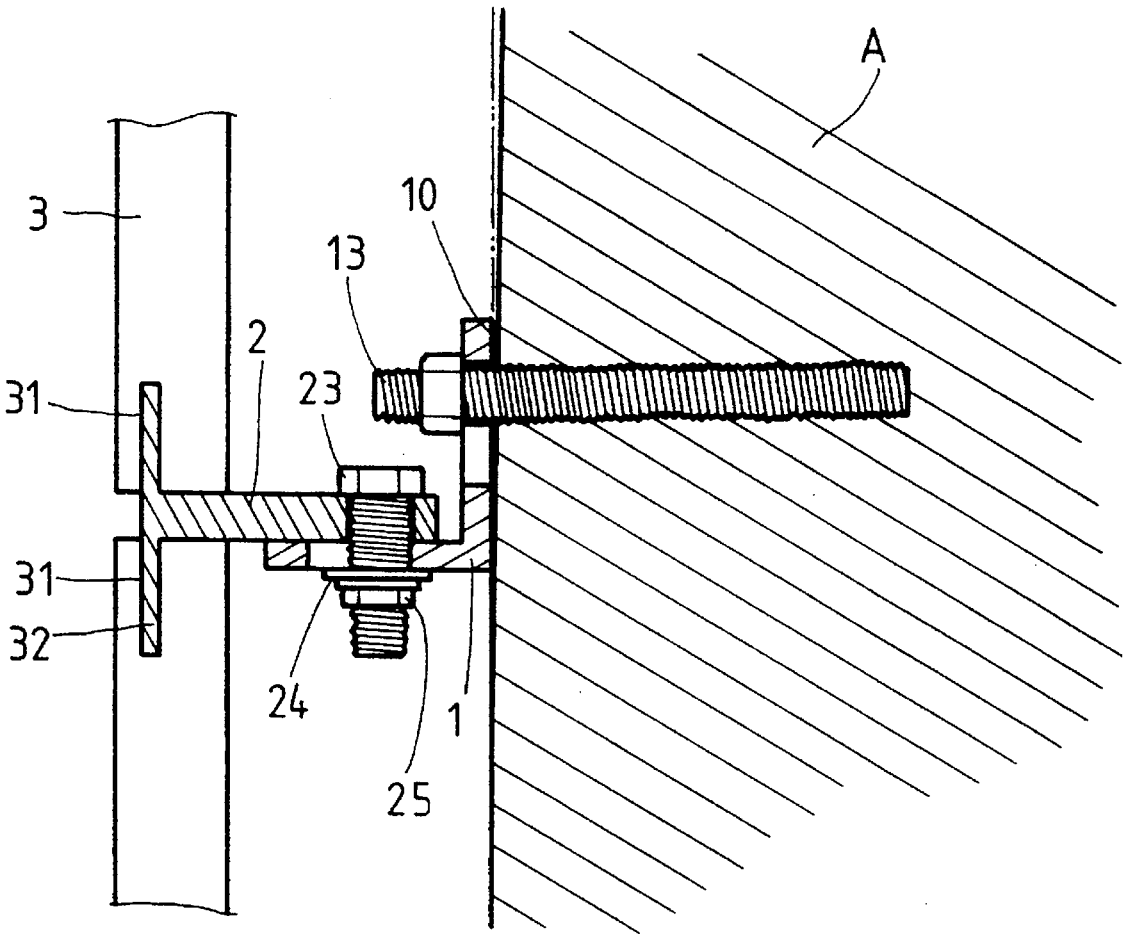
FIG. 2 PRIOR ART
FIG. 2 is a cross-sectional view of a slate positioning device of the prior art while constructing.
Figure 3:
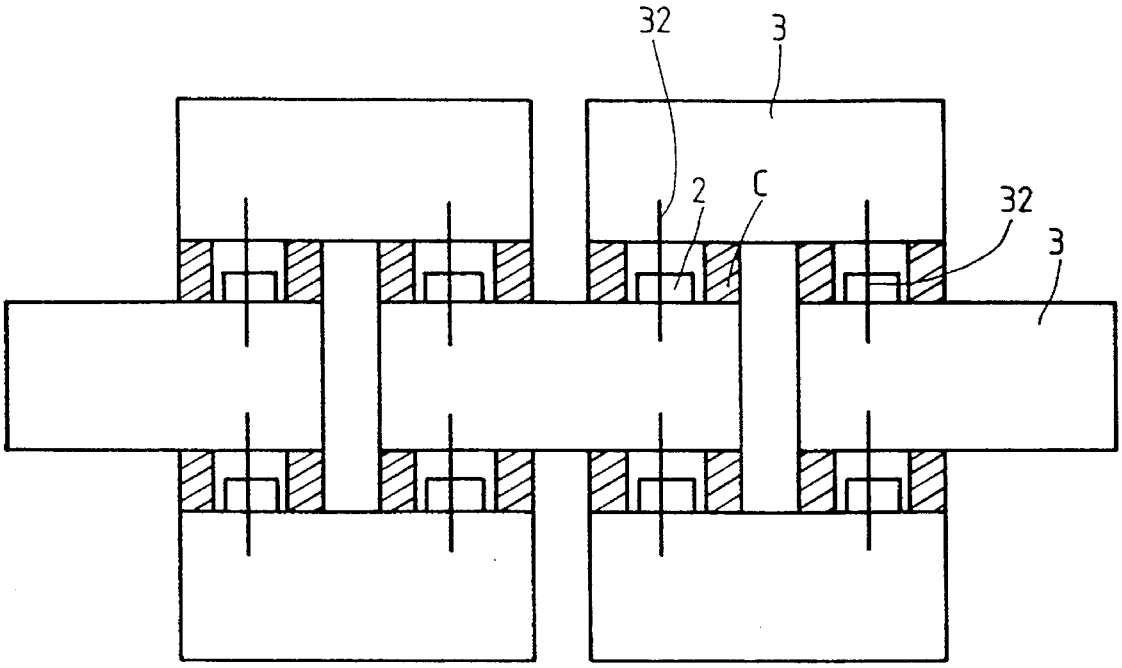
FIG.3 PRIOR ART
FIGS. 3 and 4 are schematic views illustrating the application of a plurality of the slate positioning devices of the prior art.
Figure 4:
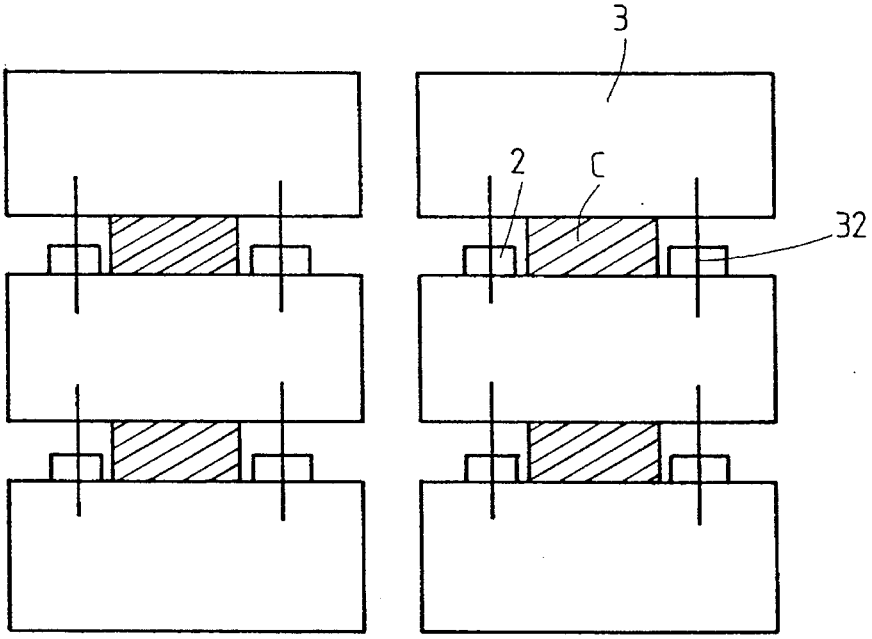
FIG.4 PRIOR ART
Figure 5:
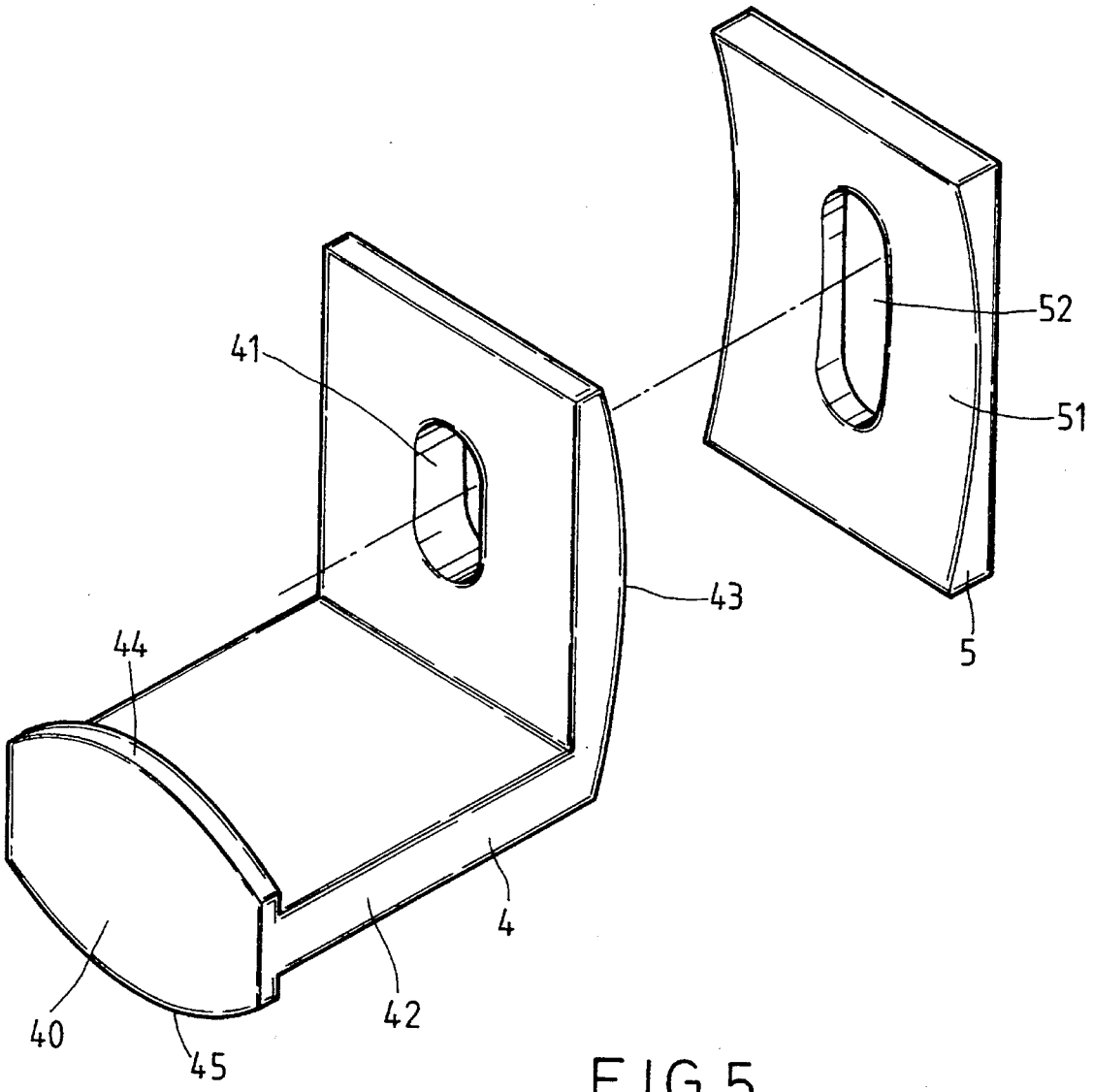
FIG. 5 is a perspective exploded view of a slate positioning device of a preferred embodiment in accordance with the invention.
Figure 6:
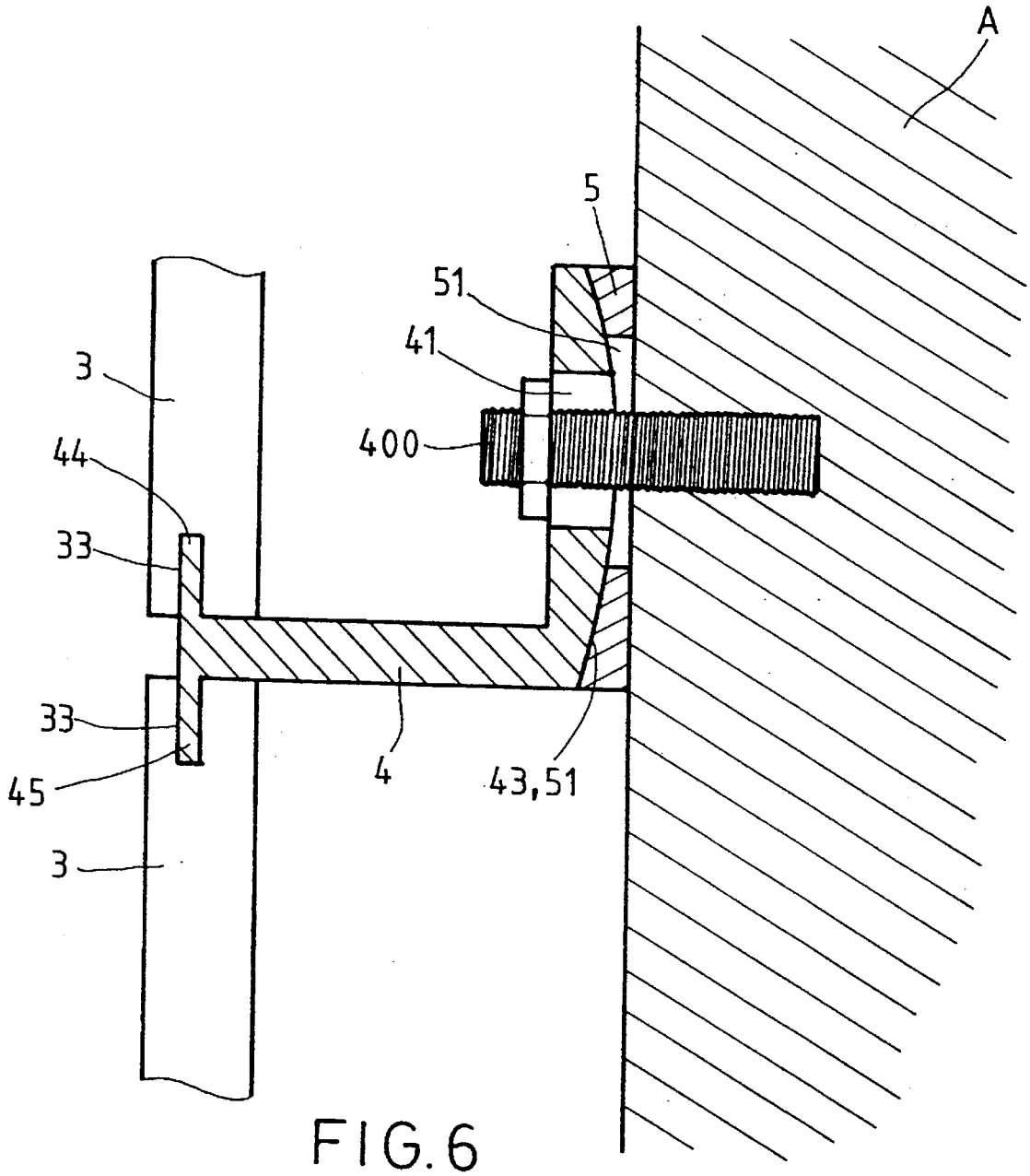
FIGS. 6 to 8 are cross-sectional views of a slate positioning device of a preferred embodiment in accordance with the invention while constructing.
Figure 7:
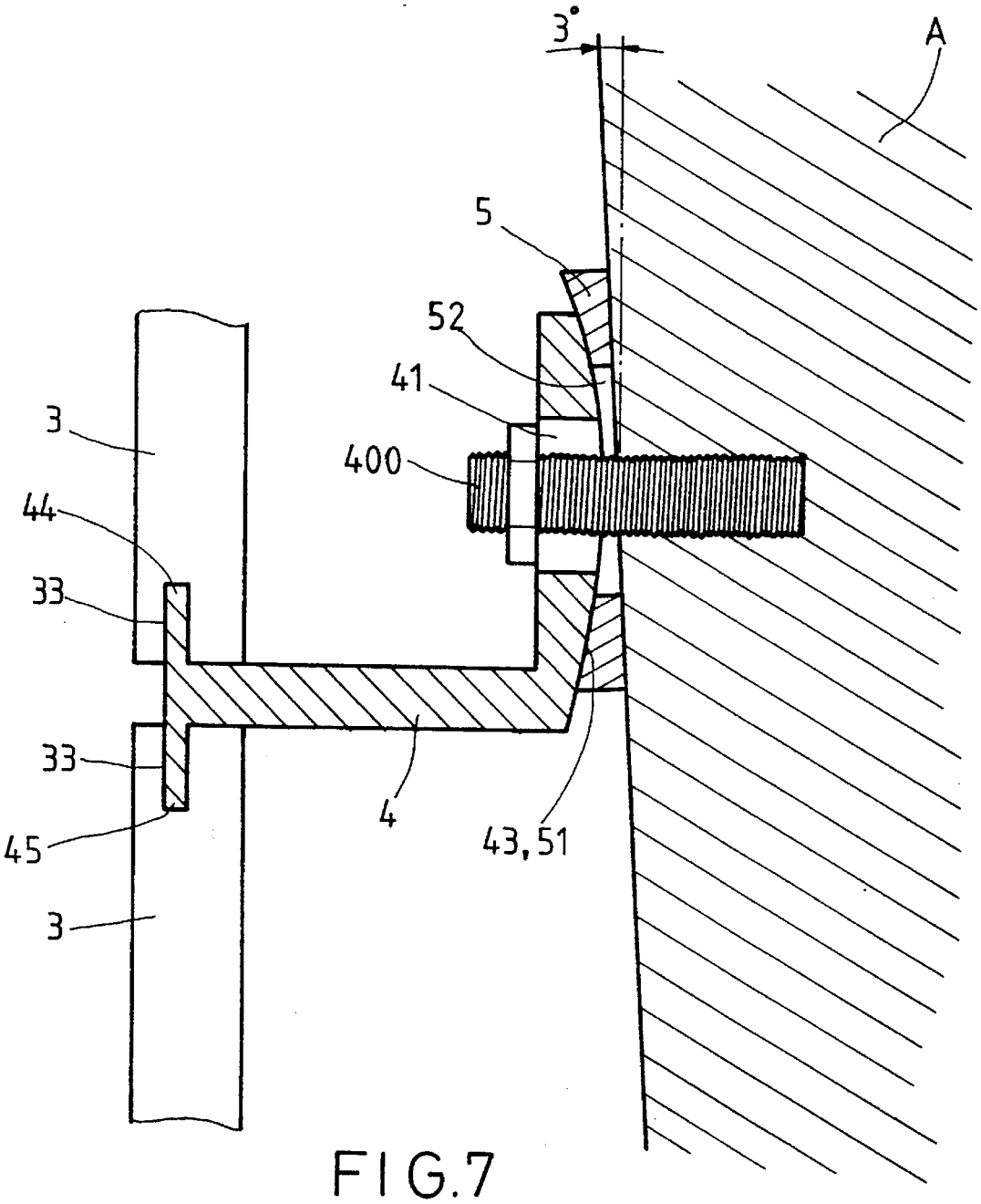
Figure 8:
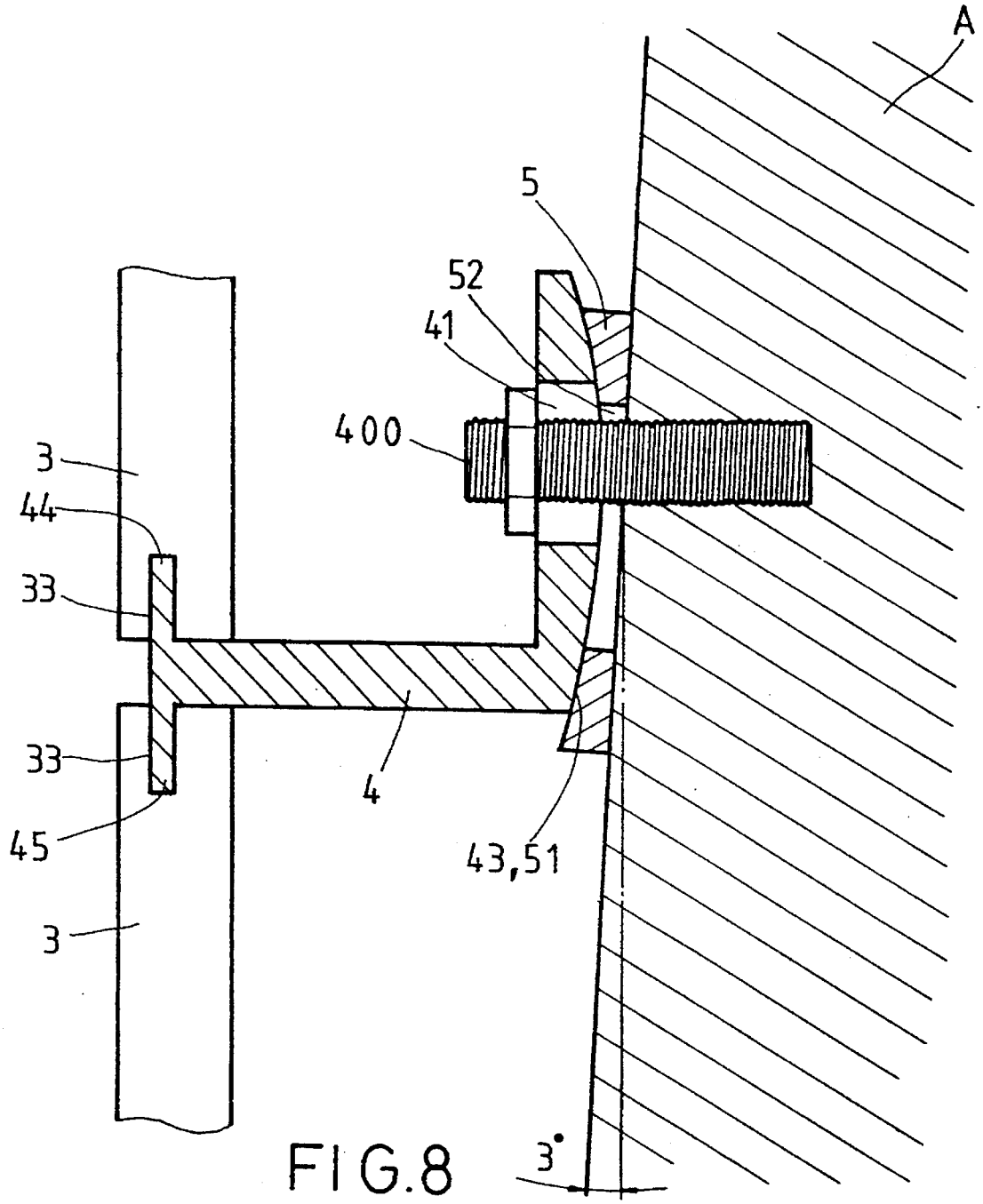

Referring to FIGS. 5 to 8, a slate positioning device has a positioning plate 4. The positioning plate 4 has a horizontal plate 42 and the first and the second longitudinal plates 43 and 40 at two ends of the horizontal plate 42. The first longitudinal plate 43 has a hole 41 and a convex surface. The second longitudinal plate 40 has an upper convex edge 44 and a lower convex edge 45. A pad plate 5 has a slot 52 and a concave surface 51 to cover the first longitudinal plate 43. The upper convex edge 44 and the lower convex edge 45 are inserted in the corresponding grooves 33 of the corresponding slates 3. A screw rod 400 passes through the hole 41 and the slot 52 to fasten the first longitudinal plate 43 and the pad plate 5 abutting the wall A. As shown in FIG. 6, the wall A is parallel to the slates 3. Then the position of the pad plate 5 need not be adjusted. Referring to FIGS. 7 and 8, the wall A is not parallel to the slates 3. Then the position of the pad plate 5 has to be adjusted.

Figure 9:
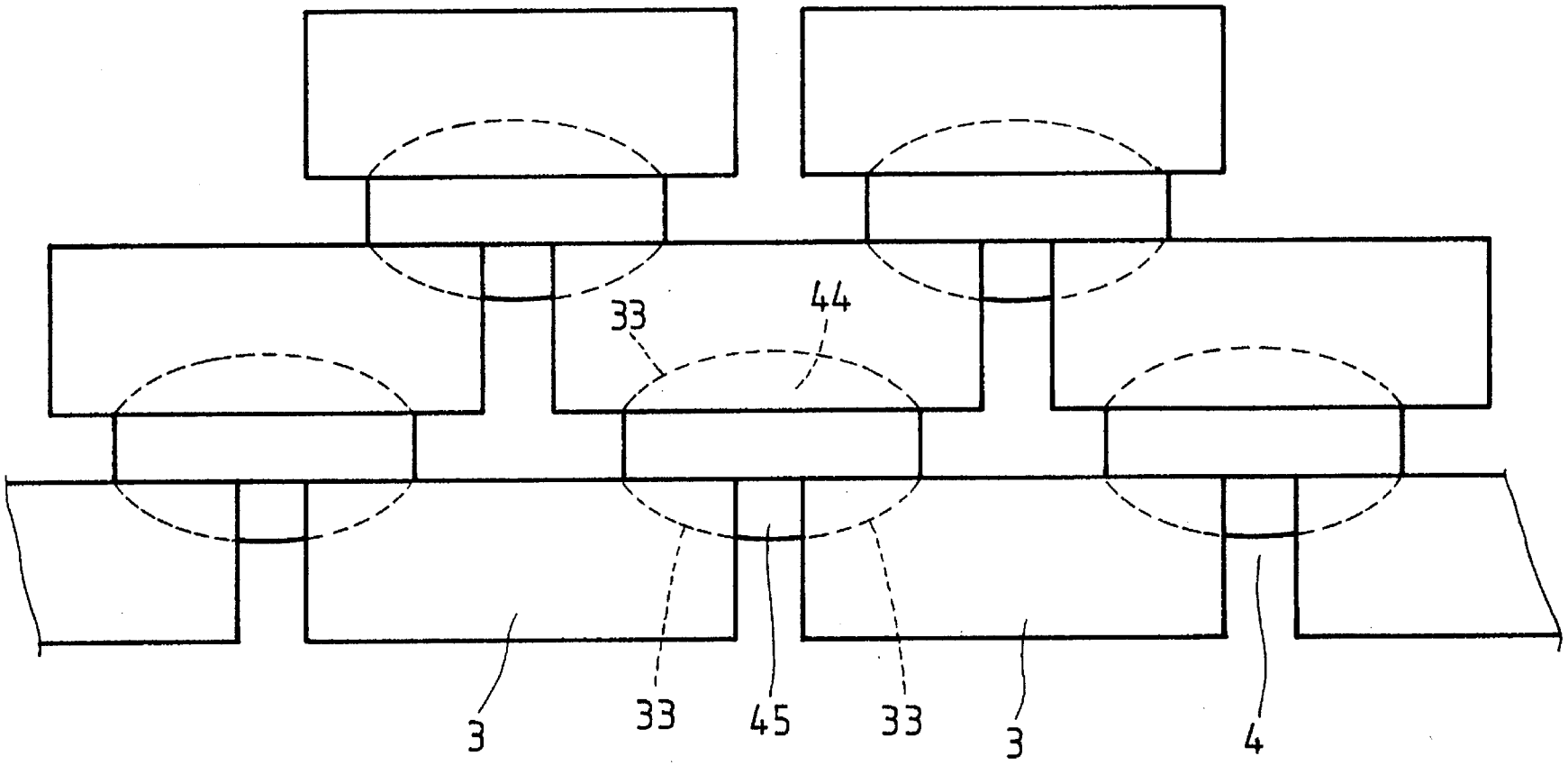
FIGS. 9 and 10 are schematic views illustrating the application of a plurality of the slate positioning devices of a preferred embodiment.
Figure 10:
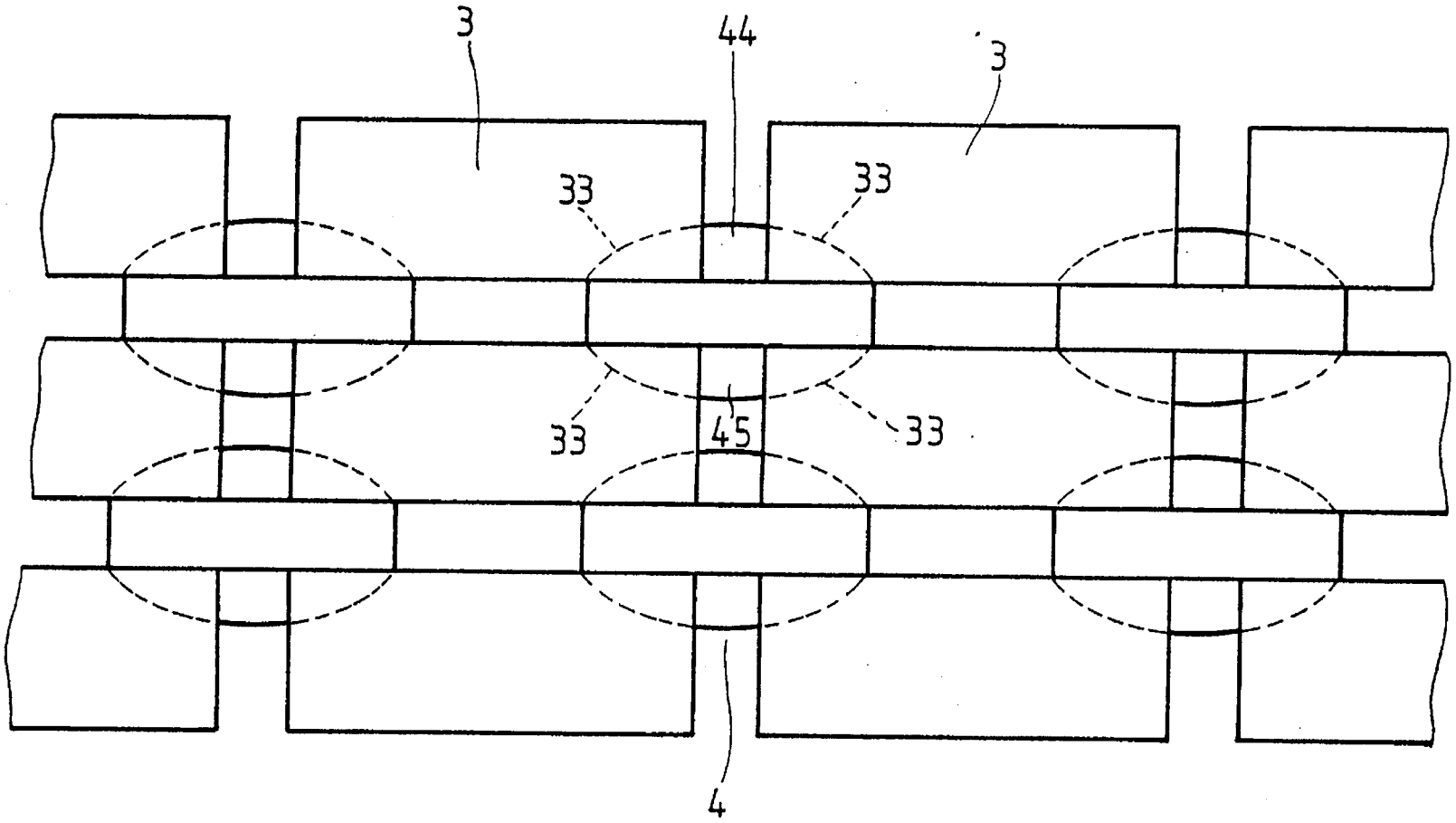
Figure 11:
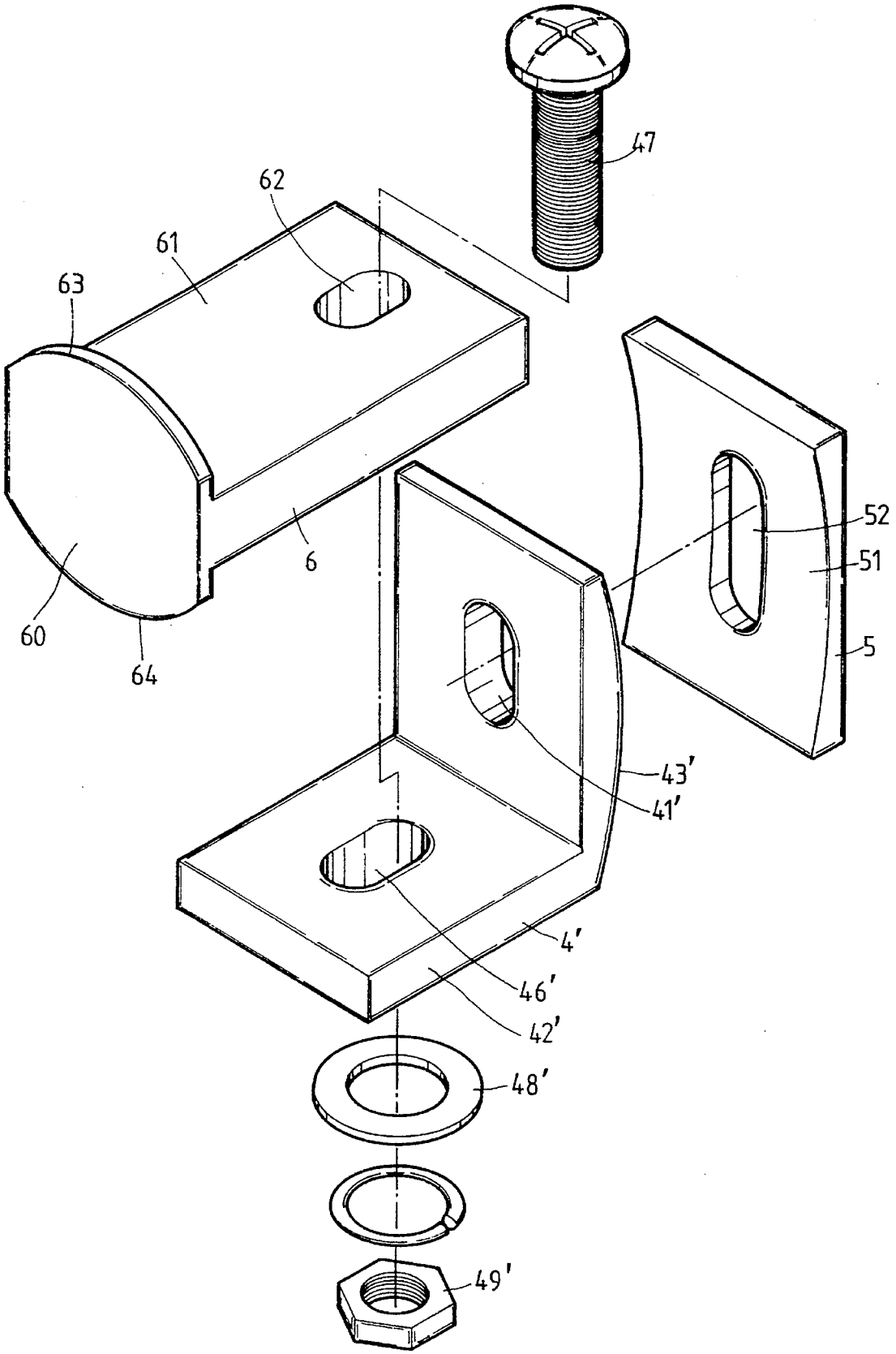
FIG. 11 is a perspective exploded view of a slate positioning device of another preferred embodiment in accordance with the invention.
Figure 12:
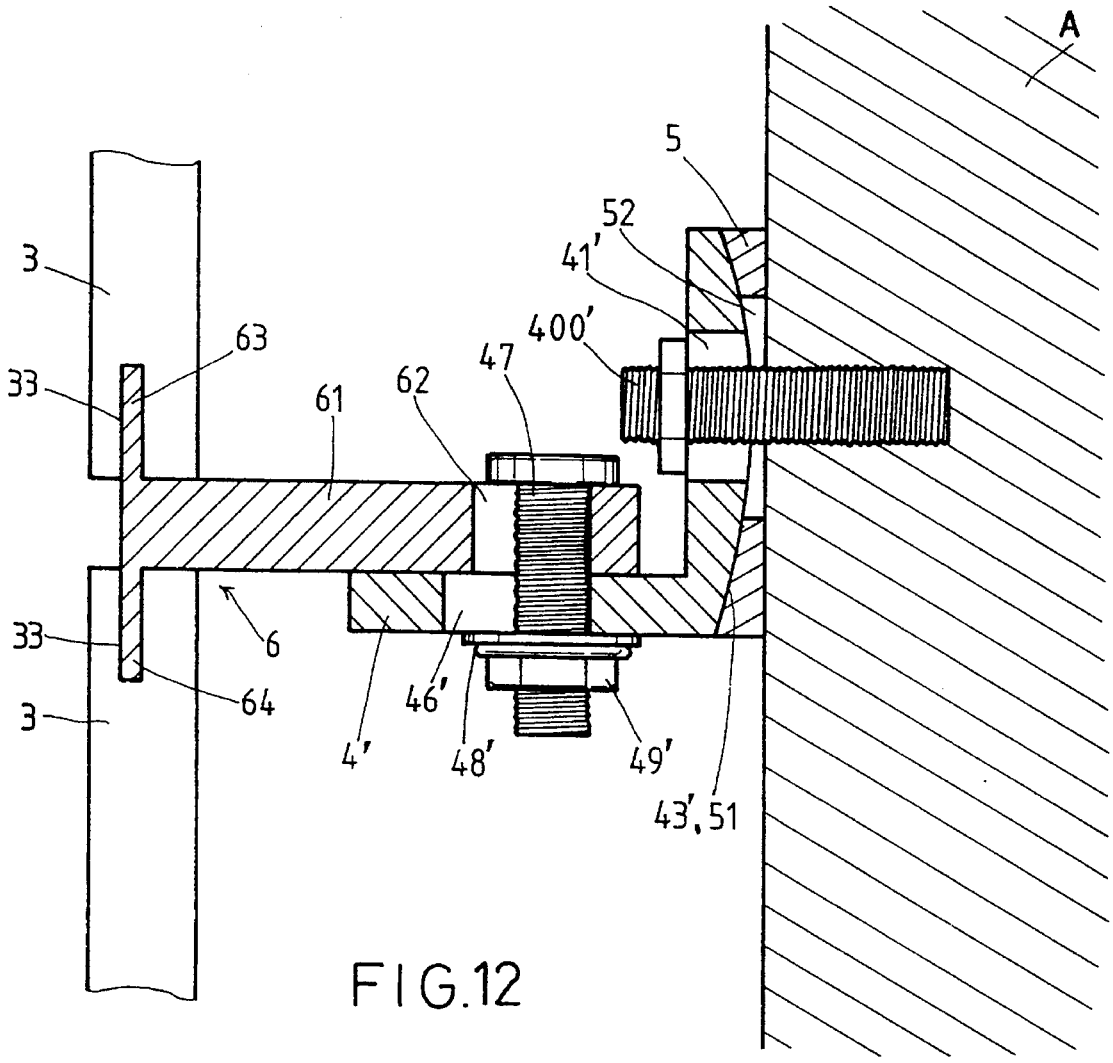
FIG. 12 is a cross-sectional view of a slate positioning device of another preferred embodiment in accordance with the invention while constructing.

FIGS. 9 and 10 illustrate the application of a plurality of the slate positioning devices. The upper convex edge 44 and the lower convex edge 45 can cross two slates 3. Thus a plurality of bolts, screw rods and padding plate are saved, Referring to FIGS. 11 and 12, a slate positioning device has an L-shaped plate 4', a horizontal positioning plate 6 and a pad plate 5. A through hole 62 is formed on the horizontal positioning plate 6. The longitudinal plate 60 which has an upper convex edge 63 and a lower convex edge 64 is disposed at one end of the positioning plate 6. The L-shaped plate 4' has a horizontal plate 42' and a pendent plate 43'. The horizontal plate 42' has an orifice 46', and the pendent plate 43' has an opening 41' and a convex surface. The pad plate 5 has a slot 52 and a concave surface 51 to cover the pendent plate 43'. The upper convex edge 63 and the lower convex edge 64 are inserted in the corresponding grooves 33 of the corresponding slates 3. A screw rod 400' passes through the opening 41' and the slot 52 to fasten the pendent plate 43' and the pad plate 5 abutting the wall A. A bolt 47 passes through the through hole 62, the orifice 46', the washer 48' and the nut 49' to fasten the positioning plate 6 on the horizontal plate 42'.

The present invention is superior to the convention slate positioning device. Whether the wall is parallel to the slates or not, the slate positioning device of the present invention can be applied perfectly. If the wall is not parallel to the slates, then the position of the pad plate can be adjusted so that the wall can be parallel to the slates.

The invention is not limited to the above embodiment but various modification thereof may be made. It will be understood by those skilled in the art that various changes in form and detail may be made without departing from the scope of the invention.

I claim:

1. A slate positioning device comprising:

a positioning plate which has a horizontal plate and a first and a second longitudinal plates at two ends of said horizontal plate;

said first longitudinal plate having a hole and a convex surface;

said second longitudinal plate having an upper convex edge and a lower convex edge;

a pad plate having a slot and a concave surface to cover said convex surface of said first longitudinal plate; and a screw rod passing through said hole and said slot to fasten said first longitudinal plate and said pad plate together.

2. A slate positioning device comprising:

an L-shaped plate, a horizontal positioning plate and a pad plate;

a through hole formed on said horizontal positioning plate;

a longitudinal plate which has, an upper convex edge and a lower convex edge disposed at one end of said positioning plate;

said L-shaped plate having a horizontal plate and a pendent plate;

said horizontal plate having an orifice;

said pendent plate having an opening and a convex surface;

said pad plate having a slot and a concave surface to cover said convex surface of said pendent plate;

said positioning plate disposed on said horizontal plate;

a screw rod passing through said opening and said slot to fasten said pendent plate and said pad plate; and a bolt passing through said through hole and said orifice to fasten said positioning plate and said horizontal plate together.

* * * * *